United States Patent [19]

Fields, III

[11] Patent Number: 4,960,222

[45] Date of Patent: Oct. 2, 1990

[54] SECONDARY LIQUID CONTAINMENT SYSTEM

[75] Inventor: Grethel C. Fields, III, Jacksonville, Fla.

[73] Assignee: Recontainer, Inc., Jacksonville, Fla.

[21] Appl. No.: 386,689

[22] Filed: Jul. 31, 1989

[51] Int. Cl.[5] ..... B65D 90/16; B65D 90/24

[52] U.S. Cl. ..... 220/5 A; 220/445; 220/571

[58] Field of Search ..... 220/5 A, 445, 18, 1 C; 222/131, 183, 482

[56] References Cited

U.S. PATENT DOCUMENTS

| | | | |
|---|---|---|---|
| 2,003,050 | 5/1935 | Iselin | 222/131 |
| 2,011,884 | 8/1935 | Watkins | 222/131 |
| 2,198,315 | 4/1940 | Nyberg | 220/445 |
| 2,412,146 | 12/1946 | Hansen | 220/445 |
| 2,419,163 | 4/1947 | Pope | 220/445 |
| 2,467,428 | 4/1949 | Hansen et al. | 220/445 |
| 2,592,974 | 4/1952 | Sulfrian | 220/445 |
| 2,668,634 | 2/1954 | Arne | 220/18 |
| 2,960,250 | 11/1960 | Haloski | 220/445 |
| 3,187,766 | 6/1965 | Black | 220/5 A |
| 3,226,467 | 12/1965 | Kienel et al. | 220/445 |
| 3,698,200 | 10/1972 | Johnson et al. | 220/445 |
| 3,822,186 | 7/1974 | Rajakovics | 220/445 |
| 4,032,047 | 6/1977 | Wilson | 222/183 |
| 4,162,020 | 7/1979 | Kirkland | 220/1 C |

*Primary Examiner*—Stephen Marcus
*Assistant Examiner*—S. Castellano
*Attorney, Agent, or Firm*—Arthur G. Yeager

[57] ABSTRACT

System for safety storage of liquids including a closed horizontal cylindrical primary tank inside a partially closed horizontal cylindrical secondary tank spaced apart from each other so as to provide an open space around the outside of the primary tank and the inside of the secondary tank. The outer secondary tank being closed at one end with a circular head and being open at the other end with its original head repositioned interiorly so as to substantially close the secondary tank and leave an open recessed area inside the tank walls and outside the repositioned head; supporting structural beams along the outside of the secondary tank to support the outside system in a horizontal position; spacer skid members inside longitudinally along the inside bottom of the secondary tank on which to rest the primary tank; vents to vent each tank to the outside atmosphere, measure relief value, and a lockable filler housing through which the primary tank can be filled with liquid; a liquid pump connected to the inside of the primary tank to pump liquid therefrom through an exit delivery hose and nozzle; a suction pipe line connecting the primary tank to the liquid pump; and a closure plug for opening and closing the suction pump line.

17 Claims, 2 Drawing Sheets

SECONDARY LIQUID CONTAINMENT SYSTEM

BACKGROUND OF THE INVENTION

The safe storage of inflammable liquids, such as petroleum products, in tanks has proved to be a more serious problem than was originally imagined. When tanks develop leaks, for one reason or another, the liquid seeps out to form pools in the surrounding low areas, and these pools may become ignited and cause widespread damage. Large ground level storage tanks at supply depots are now required to be placed separately inside levees that will prevent any leakage from spreading beyond the levees. Smaller storage tanks of 10,000–20,000 gallons found at local retail outlets may be found above or below ground level, and frequently are not protected by any type of containment system that would prevent the leaking liquid from spreading far beyond the storage tank. New installations are now being controlled by state regulations requiring some type of secondary containment system, by which is meant a system wherein the primary storage tank must also be placed in some type of secondary container to prevent the spread of leaking liquid.

In the case of existing above-ground storage tanks there is no system for providing the protection mandated by the regulations relating to new installations. Such a system is needed and the present invention provides it.

It is an object of this invention to provide a secondary containment system for horizontal cylindrical storage tanks. It is another object of this invention to provide a secondary containment system wherein the primary liquid storage tank is placed inside a larger empty secondary tank which is modified to provide all the necessary safety features and also to serve as a liquid dispensing station. Still other objects will become apparent from the more detailed description which follows.

BRIEF SUMMARY OF THE INVENTION

This invention relates to a secondary containment system for storing liquids which comprises a totally enclosed cylindrical primary storage tank for liquid inside and spaced apart from a cylindrical secondary storage tank for liquid having one circular head at a closed end and a second circular head spaced inwardly from an open end, said tanks having mutually parallel longitudinal horizontal axes; said secondary tank having two parallel elongated beam members fastened thereto on the outside of the secondary tank, generally parallel to said longitudinal axes and structurally adapted to be external supports for said secondary tank; two parallel elongated lengthwise internal skid members in said secondary tank to support said primary tank in spaced relationship to said secondary tank; said open end of said secondary tank comprising said second circular head positioned inwardly from said open end and spaced apart from said primary tank to leave a cylindrical open recess between said open end and said second circular head; horizontal flooring in said recess, a dispensing liquid pump on said flooring with a suction line from said pump to the inside of said primary tank; a first vent means from inside said primary tank to the atmosphere surrounding said secondary tank, a second vent means from the space between said secondary tank and said primary tank to the atmosphere surrounding said secondary tank, a pressure relief means for said primary tank leading to the atmosphere surrounding said secondary tank; and a passageway from outside said secondary tank to inside said primary tank for filling said primary tank with liquid.

In preferred embodiments of the invention the secondary tank is a previously used tank which is modified by moving one head inwardly and leaving an open recessed space outwardly of the repositioned head. The secondary tank is of such a size that it will prevent any leakage from the primary tank to spread beyond the secondary tank.

BRIEF DESCRIPTION OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
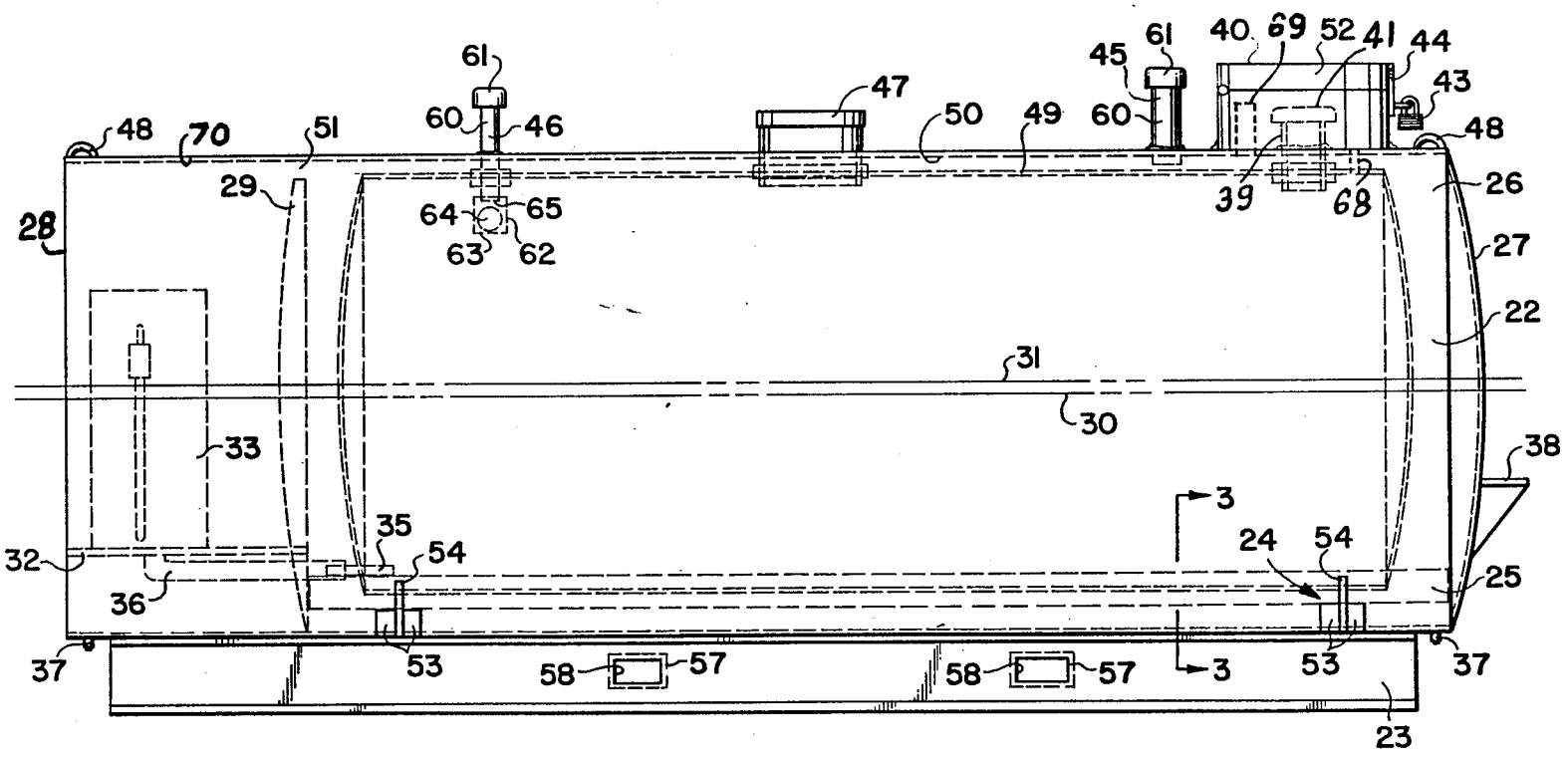
FIG. 1 is a side elevational view of the secondary containment system of this invention as it relates to a horizontal cylindrical primary storage tank.
Figure 2:
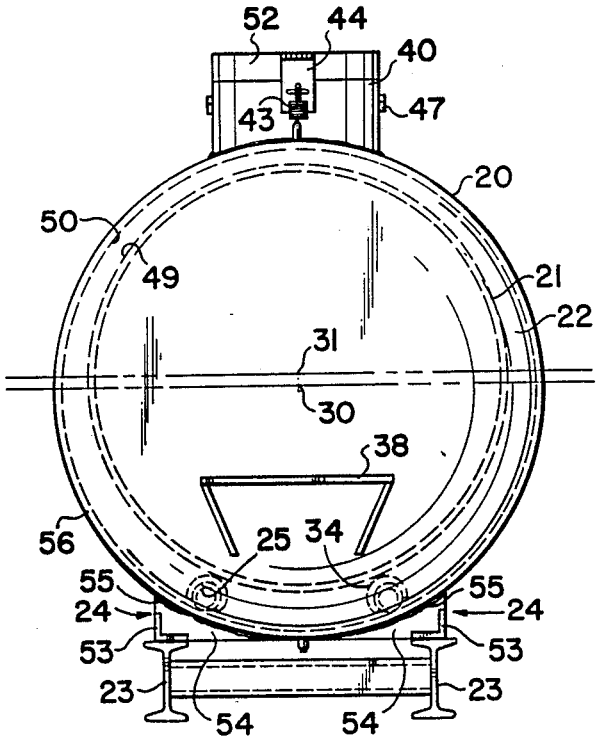
FIG. 2 is an end elevational view of the view of FIG. 1.
Figure 3:
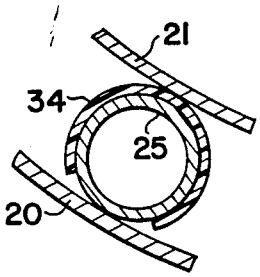
FIG. 3 is a cross sectional view taken at 3—3 of FIG. 1.

The features of the secondary containment system of this invention are best understood by reference to the accompanying drawings.

This system includes a primary tank 21 which is intended to hold the stored liquid, e.g., gasoline, diesel fuel, or the like; and a secondary tank 20 completely enclosing and supporting primary tank 21. This, of course, requires that one end of secondary tank 20 be removed so as to insert primary tank 21 thereinto. In the system shown in the drawings, head 29 is removed to leave an open end 28 and a closed end 26. Primary tank 21 is positioned so that its outside surface 49 does not touch the inside surface 50 of secondary tank 20 and thereby leaves a space 22 between the two tanks 20 and 21. This spacing may be accomplished in any feasible way; the one shown here is to weld to surface 50 at the bottom of tank 20 two elongated pipe sections 25 to serve as skids on which primary tank 21 may be slid into the interior of secondary tank 20. Preferably each pipe section 25 is covered with a portion of PVC pipe 34 to provide for ease in sliding primary tank 21 into its proper position within tank 20. More complicated structures may be used to accomplish the same purpose, e.g., welding supporting feet onto primary tank 21, putting rollers onto primary tank 21, or attaching radial spokes to tank 21 to extend outwardly to support tank 21 away from inside surface 50.

Once primary tank 21 is positioned inside secondary tank 20 so as to leave a surrounding space 22 separating the two tanks, head 29 is moved inwardly a selected space away from primary tank 21 and welded into place. Preferably, a small segment of the circular head 29 is cut off so as to leave a small open space 51 between head 29 and inside surface 50 to serve as a vent to allow gases and vapors in space 22 to escape to the surrounding atmosphere. With head 29 repositioned inwardly of its original position there is an open space or recess area 70 surrounded by the wall of tank 20 and open to the atmosphere. This open space 70 is utilized as a place to mount a liquid pump 33 with a hose and nozzle, as on the familiar gasoline pump, to dispense liquid from inside primary tank 21. A horizontal flooring 32 is welded across the lower part of open space 70 and the liquid pump 33 rests on the flooring. Piping outlet 35 is installed to conduct the liquid from tank 21 to pump 33 via flexible connecting piping 36. If desired, a plug or valve (not shown) may be included in piping outlet 35 or in flexible connecting pipe 36 to permit pump 33 to be detached for maintenance. Of course, a standard gate valve or globe valve can be used for this purpose.

The entire system is shown in the horizontal position where in the longitudinal axis 30 of secondary tank 20 and the horizontal axis 31 of primary tank 21 are parallel and substantially horizontal. The system must have some type of support or foundation to keep it fixed and immobile in position. Concrete or masonry supports can be used. In the drawing the supports are elongated I-beams placed horizontally on the ground with secondary tank 20 resting on the beams, preferably resting on two or more saddles 24 comprising angle beams 53 and plate 54 cut to fit the contour of outside surface 56 of secondary tank 20 and welded thereto at 55. The drawing shows two angle beams 53 with plate 54 sandwiched therebetween welded to the top of I-beams 23, and to secondary tank 20 at 55. The entire structure includes two lifting eyes 48 by means of which a crane can lift the tanks for placement, and two open-end box beams 57 connecting I-beams 23 together and providing openings 58 for times of a fork lift truck to device or lift the entire assembly.

Primary tank 21 is filled with liquid through a filler pipe 39 on the top of secondary tank 20. Filler pipe 39 passes through the walls of both tanks 20 and 21 to the interior of primary tank 21. A cap 41 is removably attachable to filler pipe 39, preferably welded to tank 21 and screwed into tank 20 by pipe threads. Filler pipe 39 and cap 41 are enclosed in a housing 40 having a hinged top 52, a hasp 44, and a padlock 43. Unauthorized access to the interior of tank 20 is thereby prohibited. In the event that a spillage in housing 40 occurs, the spillage can be returned to primary tank 21 via flexible conduit 68 and even a standpipe 69 may be installed to return spillage beyond the capacity of open housing 40 to the secondary tank 20. The secondary tank 20 may be drained as necessary via one or more closeable drains 37 adjacent the bottom of the secondary tank 20 which drains 37 communicate with the space between the primary tank 21 and secondary tank 20.

Two vent devices 45 and 46 are shown, the former venting space 22 between tanks 20 and 21 to the outside atmosphere and the latter venting the interior of tank 21 to the outside atmosphere. The structure of each of the vents preferably includes a tube 60 with a cap 61 over the outer end to allow flow of gases outwardly while preventing rain or dirt or rocks or the like from being introduced into either vent from outside. Also, a liquid level shutoff valve 62 is provided at the lower end of tube 60 of vent 46, valve 62 including a wire cage 63 and a float ball shutoff valve 64. When the liquid level in primary tank 21 is sufficiently high, the ball 64 will float upwardly to close the lower end 65 of tube 60 to inhibit egress of the liquid which may be caused by overfilling tank 22 and/or heat expansion of a full tank.

There also is a pressure relief valve member 47 communicating the inside of primary tank 21 with the atmosphere surrounding secondary tank 20. This may be any design which will at some selected interval pressure open to release that pressure to the atmosphere. Such a pressure relief valve could also be placed to release any excess pressure buildup in the space 22 between tanks 20 and 21, but generally that space will not be subjected to pressures because of vent 45.

The above description discusses horizontal tanks, but it should be realized that the general spirit of this invention also can be applied to vertical tanks, although vertical tanks are not usually employed for liquids because the head pressure becomes excessive for any sizeable vertical heights.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what it is desired to secure by Letters Patent of the United States is:

1. A secondary containment system for storing liquids which comprises a totally enclosed cylindrical primary storage tank for liquid inside and spaced apart from a cylindrical secondary storage tank for liquid having one circular head at a closed end and a second circular head spaced inwardly from an open end, said tanks having mutually parallel longitudinal horizontal axes; said secondary tank having two parallel elongated beam members fastened thereto on the outside of the secondary tank, generally parallel to said longitudinal axes and structurally adapted to be external supports for said secondary tank; two parallel elongated lengthwise internal skid members in said secondary tank to support said primary tank in spaced relationship to and within said secondary tank; said open end of said secondary tank comprising said second circular head positioned inwardly from said open end and spaced apart from said primary tank to leave a cylindrical open recess between said open end and said second circular head; horizontal flooring in said recess, a dispensing liquid pump on said flooring with a suction line from said pump to the inside of said primary tank; a first vent means from inside said primary tank to the atmosphere surrounding said secondary tank, a pressure relief means for said primary tank leading to the atmosphere surrounding said secondary tank; and a passageway from outside said secondary tank to inside said primary tank for filling said primary tank with liquid.

2. The containment system of claim 1 wherein said secondary tank is a previously used liquid storage tank with one head having been removed, for inserting said primary tank inside said secondary tank, and with said removed head being reaffixed to said secondary tank inwardly from its original position.

3. The containment system of claim 1 wherein said passageway is a substantially vertical filler pipe on the top of said secondary tank and passing through said secondary tank and said primary tank from outside said secondary tank to inside said primary tank, a removable cap on said filler pipe, and a lockable enclosure around said cap and the portion of said filler pipe which is outside said secondary tank.

4. The containment system of claim 1 wherein said internal elongated skid members are two lengths of pipe welded to the inside of said secondary tank generally adjacent to and parallel to said beam members and adapted to function as a seat for said primary tank inside said secondary tank and to space said primary tank from said secondary tank.

5. The containment system of claim 4 wherein each said skid member includes a covering of PVC pipe.

6. The containment system of claim 1 further comprising a second vent means from a space between said secondary tank and said primary tank to the atmosphere surrounding said secondary tank.

7. The containment system of claim 3 which additionally comprises a step member welded to the outside of said secondary tank adjacent said passageway and adapted to provide a step for reaching said filler pipe.

8. The containment system of claim 1 which additionally comprises a means for opening and closing said suction line.

9. The containment system of claim 6 wherein said second vent means includes a passageway at the top of said second circular head to permit fluid flow from said space between said primary and secondary tanks to atmosphere surrounding said secondary tank.

10. The containment system of claim 1 which includes a closeable drain adjacent the bottom said secondary tank communicating with the space between said primary and secondary tanks.

11. The containment system of claim 3 which additionally includes a drainage passageway said enclosure and passing through said secondary tank to said primary tank to return spillage of liquid in said enclosure to said primary tank.

12. The containment system of claim 1 which additionally includes at least two lifting eyes said secondary tank structured and arranged to provide a connection to a hook of a crane.

13. The containment system of claim 1 which additionally includes two open ended box beams joining said parallel elongated beam members in a lateral direction structured and arranged to receive tines of a fork lift for lifting said containment system.

14. The containment system of claim 1 wherein said first vent means includes a shutoff valve to inhibit the liquid flow from said primary tank through said first vent means.

15. The containment system of claim 14 wherein said shutoff valve includes a float ball disposed within said primary tank to close said first vent means when said primary tank is substantially full of liquid.

16. The containment system of claim 3 which includes a standpipe in said enclosure passing into said secondary tank to return spillage of liquid in said enclosure to said secondary tank.

17. The containment system of claim 6 wherein each said first and second vent means is a pipe extending from outside said secondary tank to inside respective said primary tank and said secondary tank, said pipe providing a substantially unobstructed passageway for gases and vapors to flow to the atmosphere outside said secondary tank.

* * * * *